US009243358B2

(12) United States Patent
Yamaguchi

(10) Patent No.: US 9,243,358 B2
(45) Date of Patent: Jan. 26, 2016

(54) GUIDING TOOL FOR SEWING MACHINE AND SET OF GUIDING TOOL AND RULED SHEET

(71) Applicant: CLOVER MFG. CO., LTD., Osaka-shi, Osaka (JE)

(72) Inventor: Mariko Yamaguchi, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 14/457,345

(22) Filed: Aug. 12, 2014

(65) Prior Publication Data

US 2015/0047542 A1 Feb. 19, 2015

(30) Foreign Application Priority Data

Aug. 19, 2013 (JP) ..... 2013-169450

(51) Int. Cl.
*D05B 35/10* (2006.01)
*D05B 35/12* (2006.01)

(52) U.S. Cl.
CPC ..... *D05B 35/10* (2013.01); *D05B 35/12* (2013.01)

(58) Field of Classification Search
CPC ..... D05B 35/00; D05B 35/02; D05B 35/10; D05B 35/08; D05B 35/105; D05B 73/12; D05B 35/12
USPC ..... 112/151, 153, 308
See application file for complete search history.

(56) References Cited

U.S. PATENT DOCUMENTS

| | | | | | |
|---|---|---|---|---|---|
| 820,523 | A | * | 5/1906 | Sandler | 112/153 |
| 855,286 | A | * | 5/1907 | Dantzig et al. | 112/153 |
| 1,061,090 | A | * | 5/1913 | Levy | 112/153 |
| 1,117,564 | A | * | 11/1914 | Halliday | 112/153 |
| 2,317,614 | A | * | 4/1943 | Johnston | 112/136 |
| 2,711,704 | A | * | 6/1955 | Maczuga et al. | 112/153 |
| 3,186,365 | A | * | 6/1965 | Chudner | 112/153 |
| 3,228,365 | A | * | 1/1966 | Yoshida | 112/153 |
| 3,401,658 | A | * | 9/1968 | Kirby | 112/153 |
| 3,924,551 | A | * | 12/1975 | Heiler et al. | 112/153 |
| 4,449,465 | A | * | 5/1984 | Kirby | 112/153 |
| 4,509,444 | A | * | 4/1985 | Howe et al. | 112/475.01 |

FOREIGN PATENT DOCUMENTS

JP U-S54-6591 Y 3/1979

* cited by examiner

*Primary Examiner* — Ismael Izaguirre
(74) *Attorney, Agent, or Firm* — Hamre, Schumann, Mueller & Larson, P.C.

(57) ABSTRACT

A guiding tool for a sewing machine includes a first guiding member and a second guiding member. Each of the first guiding member and the second guiding member includes a base portion having a predetermined periphery, a guide surface facing to a side of the base portion, and a connecting portion for connection of the first guiding member and the second guiding member. The base portion includes a bottom surface provided with an attaching portion for attaching the guiding tool to an attachment surface of an object due to adhesion or suction. The guide surface of the first guiding member and the guide surface of the second guiding member are configured to be flush with each other when the first guiding member and the second guiding member are connected to each other.

7 Claims, 17 Drawing Sheets

GUIDING TOOL FOR SEWING MACHINE AND SET OF GUIDING TOOL AND RULED SHEET

BACKGROUND OF THE INVENTION

1. Field of the Invention

The present invention relates to a guiding tool for guiding material to be stitched with a sewing machine. The present invention also relates to a set of such a guiding tool and a ruled sheet.

2. Description of the Related Art

In performing sewing work with a sewing machine, use may be made of a guiding tool for guiding fabric (or other materials) so as to provide a margin of a constant width. JP-U-S54-6591Y, for example, discloses a guiding tool provided with a permanent magnet for a metal needle plate. In use, the guiding tool is attached magnetically to a desired spot of the needle plate of the sewing machine, and the fabric is fed forward through the sewing machine while the edge of the fabric being kept in contact with a guide surface of the guiding tool.

The conventional guiding tool utilizes magnetic force for attachment. Thus, when the needle plate is made of a non-magnetic material such as a synthetic resin, the guiding tool cannot be used for the plate. Further, the guide surface of the conventional tool is rather short, which may be disadvantageous to guiding the fabric properly.

SUMMARY OF THE INVENTION

The present invention has been proposed under the above-described circumstances. It is therefore an object of the present invention to provide a guiding tool for a sewing machine, which can be attached to a desired position regardless of the material of the attachment surface and which has good guiding effects.

According to a first aspect of the present invention, there is provided a guiding tool for a sewing machine. The guiding tool includes a first guiding member and a second guiding member. Each of the first guiding member and the second guiding member includes a base portion having a predetermined periphery, a first guide surface connected to the base portion, and a connecting portion for connection of the first guiding member and the second guiding member to each other. The base portion includes a bottom surface provided with an attaching portion to be attached to an object (such as the needle plate of a sewing machine) by adhesion or suction. The first guide surface of the first guiding member and the first guide surface of the second guiding member are configured to be flush with each other when the first guiding member and the second guiding member are connected to each other.

In an embodiment, each of the first guiding member and the second guiding member includes a second guide surface and a third guide surface both connected to the base portion of each of the first guiding member and the second guiding member. Further, in each of the first guiding member and the second guiding member, the first, the second and the third guide surfaces extend along a first edge, a second edge and a third edge of the periphery of the base portion, respectively, where the third edge is shorter than the second edge, and the second edge is shorter than the first edge.

In an embodiment, the first, the second and the third edges of the first guiding member are line-symmetric to the first, the second and the third edges of the second guiding member, respectively.

In an embodiment, the base portion of each of the first and the second guiding members is in a form of a flat plate, each of the first and the second guiding members includes an upright wall standing on the periphery of the base portion and extending along the entirety of the periphery, and the upright wall includes an outer surface providing the first, the second and the third guide surfaces.

In an embodiment, in each of the first guiding member and the second guiding member, the attaching portion includes an adhesive surface projecting outward from the bottom surface of the base portion.

In an embodiment, the attaching portion is provided with a self-adhesive sheet including a first surface and a second surface facing in mutually opposite directions. The first surface is fixed to the bottom surface of the base portion, and the second surface provides the adhesive surface.

In an embodiment, the bottom surface of the base portion is provided with a recess having a depth smaller than a thickness of the attaching portion, and the attaching portion is partially fitted in the recess.

According to a second aspect of the present invention, there is provided a set of a guiding tool according to the first aspect and a ruled sheet to be used with the guiding tool. The ruled sheet includes at least one straight edge and a plurality of guidelines spaced apart from the straight edge.

In an embodiment, the ruled sheet includes a first surface and a second surface facing in mutually opposite directions, where the first surface is configured to be smooth, and the second surface is provided with the plurality of guidelines.

Other features and advantages of the present invention will become more apparent from detailed description given below with reference to the accompanying drawings.

DESCRIPTION OF THE PREFERRED EMBODIMENTS

Preferred embodiments of the present invention are described below with reference to the accompanying drawings.

Figure 1:
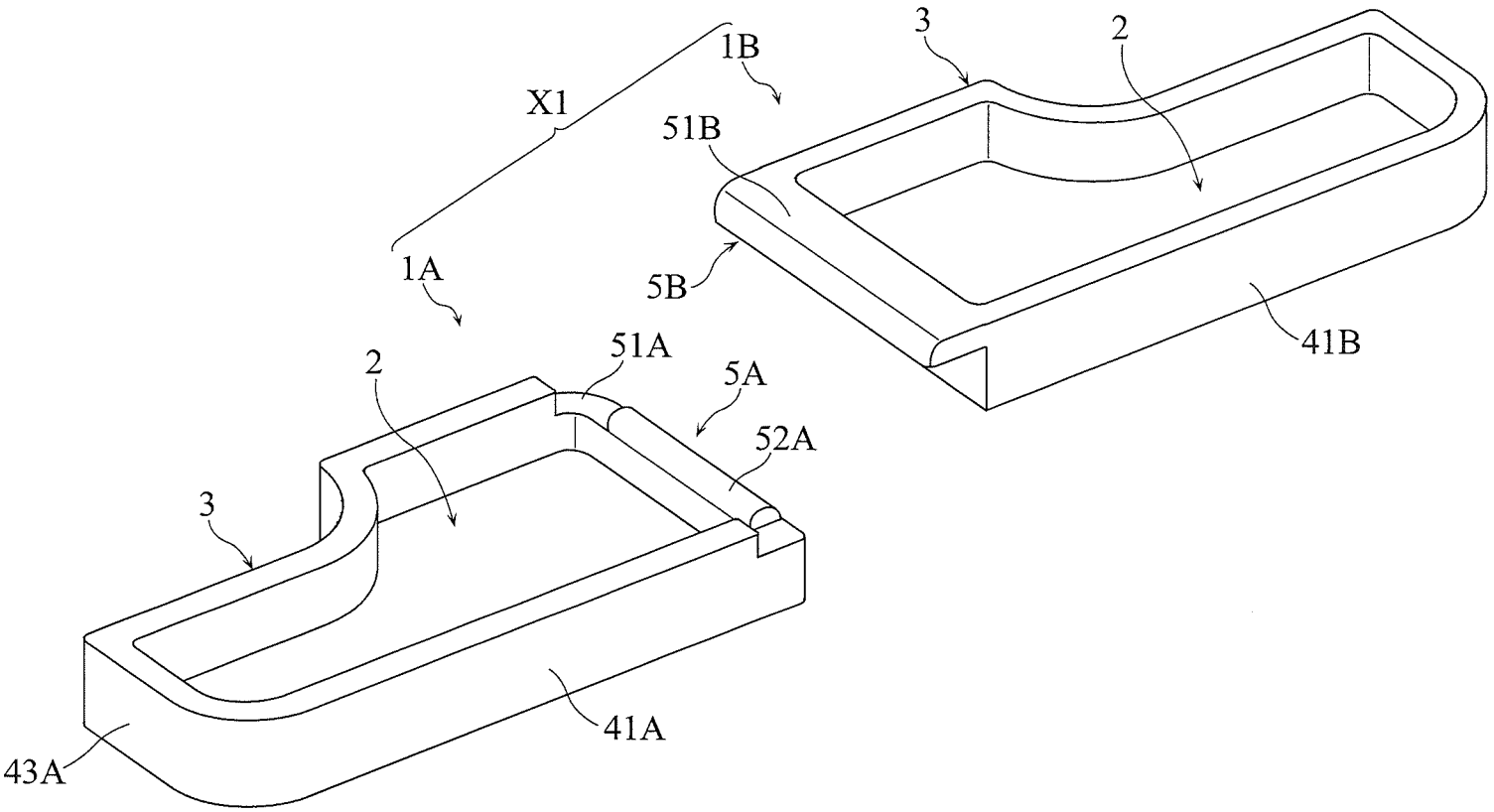
FIG. 1 is a perspective view of a guiding tool for a sewing machine according to an embodiment of the present invention.

FIGS. 1-13 show a guiding tool according to an embodiment of the present invention. The illustrated guiding tool X1 can be used for a sewing machine, though the present invention is not limited to this. As shown in FIG. 1, the guiding tool X1 includes two guiding members 1A and 1B. When used, the guiding tool X1 is attached to a desired object, typically, the needle plate of a sewing machine.

Figure 2:
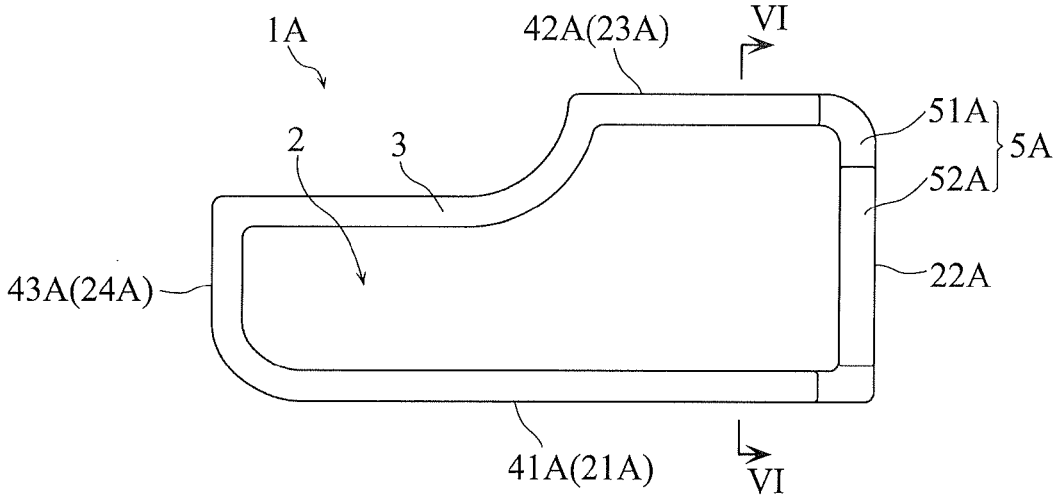
FIG. 2 is a plan view of one of guiding members of the guiding tool shown in FIG. 1.
Figure 3:
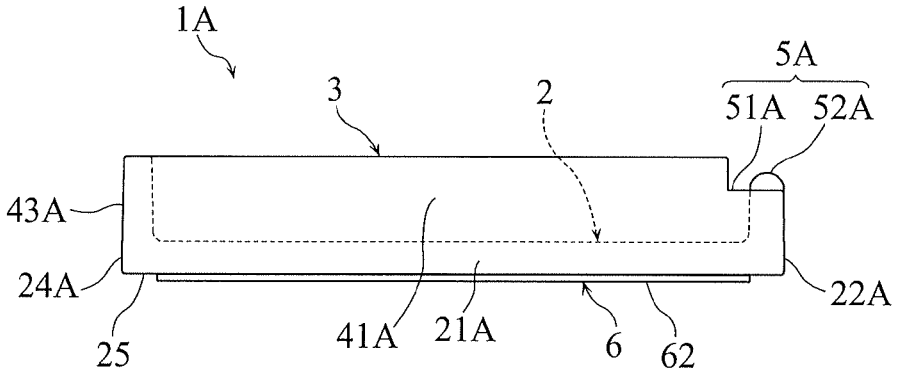
FIG. 3 is a front view of the guiding member shown in FIG. 2.
Figure 4:
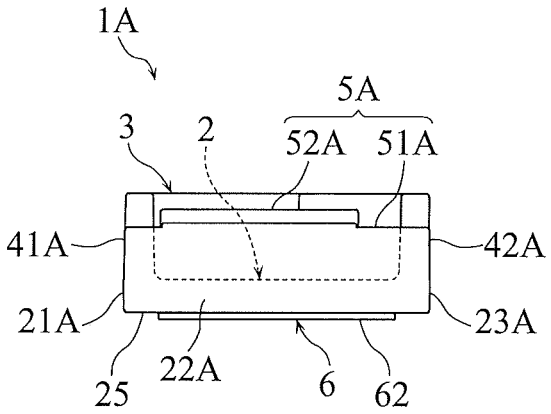
FIG. 4 is a side view of the guiding member shown in FIG. 2.
Figure 7:
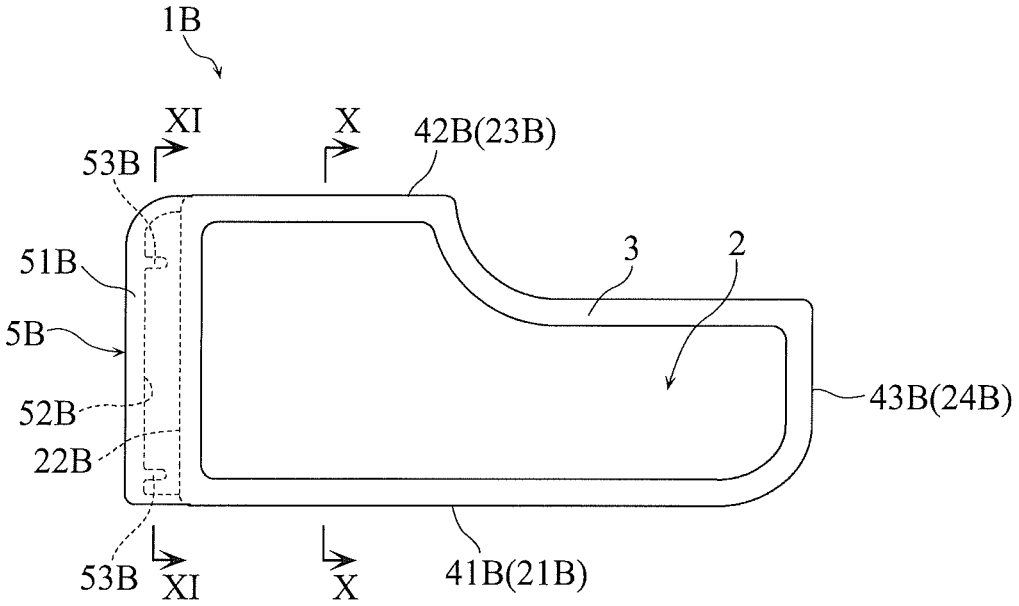
FIG. 7 is a plan view of the other one of the guiding members of the guiding tool shown in FIG. 1.

Each of the guiding members 1A and 1B includes a base portion 2 in the form of a flat plate, and a standing wall or upright wall 3 standing upright on the periphery of the base portion 2. As shown in FIG. 2, the guiding member 1A has guide surfaces 41A, 42A and 43A each facing in a direction perpendicular to the normal direction of the upper surface of the base portion 2. In other words, each guide surface 41A, 42A, 43A faces in a direction parallel to the upper surface of the base portion 2. In the illustrated example, the three guide surfaces 41A, 42A and 43A face in mutually different directions, that is, downwards, upwards and to the left, respectively. Similarly, as shown in FIG. 7, the guiding member 1B has guide surfaces 41B, 42B and 43B facing in mutually different directions, i.e., downwards, upwards and to the right, respectively.

Figure 5:
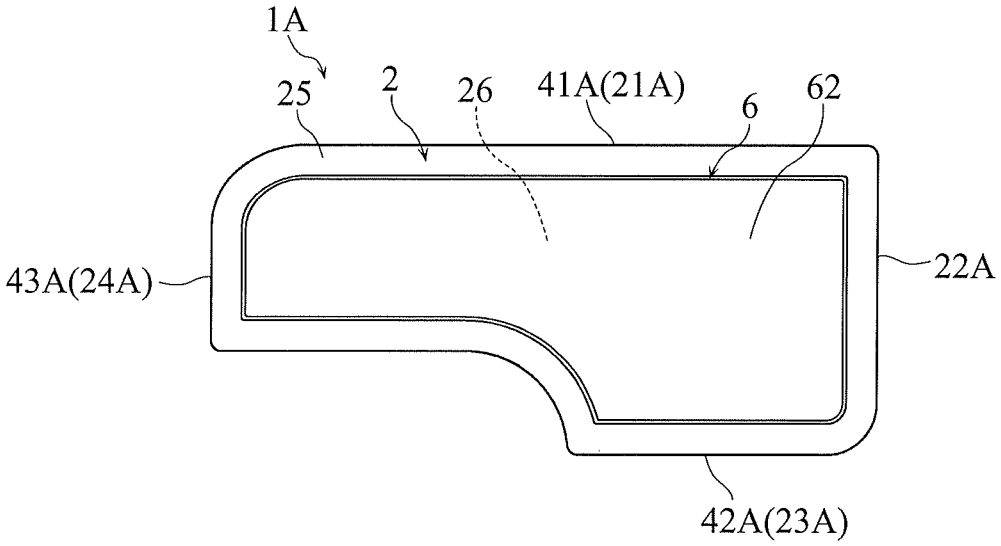
FIG. 5 is a bottom view of the guiding member shown in FIG. 2.

As shown in FIGS. 1, 2 and 5, the periphery of the base 2 of the guiding member 1A has a shape obtained by cutting away a part of an elongated rectangle so that a dent is formed at the cut-away portion. Specifically, the periphery of the base 2 has a shape obtained by cutting away one corner (upper left corner in FIG. 2) of an elongated rectangle to form a dent at the corner, i.e., cutting away a part of one of two longer sides and a part of one of two shorter sides of a rectangle.

Thus, the periphery of the base portion 2 includes an edge 23A corresponding to the partially-cut-away longer side described above, an edge 21A corresponding to the other longer side, an edge 24A corresponding to the partially-cut-away shorter side described above; and an edge 22A corresponding to the other shorter side. In this embodiment, the edge 23A is shorter than the edge 21A, and the edge 24A is shorter than the edge 23A. The joint portion of the edge 21A and the edge 24A is rounded.

As shown in FIGS. 2-4 and 6, in the guiding member 1A, the standing wall 3 extends along the entire periphery of the base portion 2 and has a continuous outer surface standing on the edges 21A-24A of the base portion 2. The outer surface of the standing wall 3 provides guide surfaces 41A, 42A and 43A. In this embodiment, all of the guide surfaces 41A, 42A and 43A are made flat. The guide surface 41A extends along the edge 21A of the base portion 2 and is made up of the edge 21A and the portion of the outer surface which stands on the edge 21A. The guide surface 42A extends along the edge 23A and is made up of the edge 23A and the portion of the outer surface which stands on the edge 23A. The guide surface 42A is adjacent to the above-described dent of the periphery of the base portion 2. The guide surface 43A extends along the edge 24A and is made up of the edge 24A and the portion of the outer surface which stands on the edge 24A.

Figure 9:
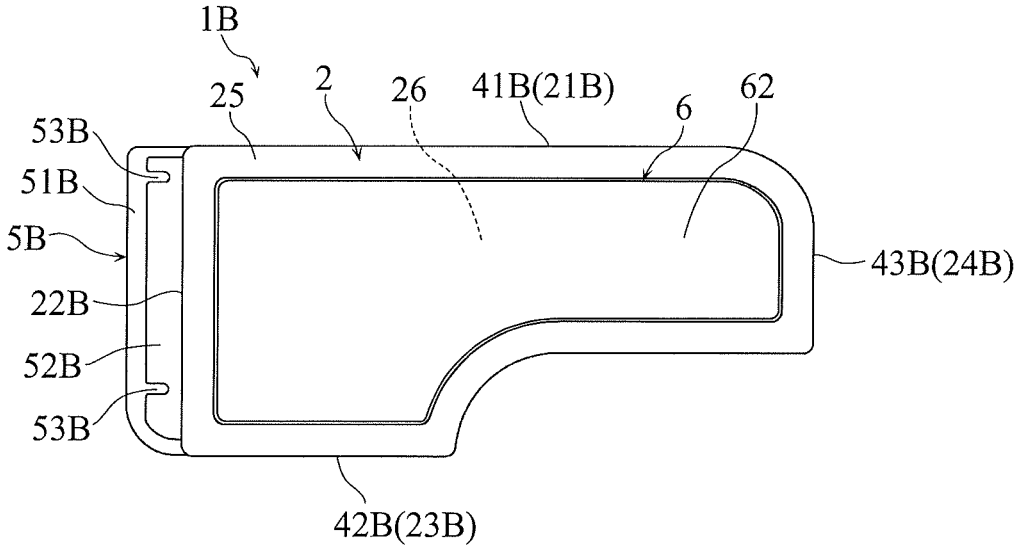
FIG. 9 is a bottom view of the guiding member shown in FIG. 7.

As shown in FIGS. 1, 7 and 9, the periphery of the base 2 of the guiding member 1B has a shape obtained by cutting away apart of an elongated rectangle so that a dent is formed at the cut-away portion. Specifically, the periphery of the base 2 has a shape obtained by cutting away one corner (upper right corner in FIG. 2) of an elongated rectangle to form a dent at the corner, i.e., cutting away a part of one of two longer sides and a part of one of two shorter sides of a rectangle.

Thus, the periphery of the base portion 2 includes an edge 23B corresponding to the partially-cut-away longer side described above, an edge 21B corresponding to the other longer side, an edge 24B corresponding to the partially-cut-away shorter side described above, and an edge 22B corresponding to the other shorter side. In this embodiment, the edge 23B is shorter than the edge 21B, and the edge 24B is shorter than the edge 23B. The joint portion of the edge 21B and the edge 24B is rounded.

Figure 8:
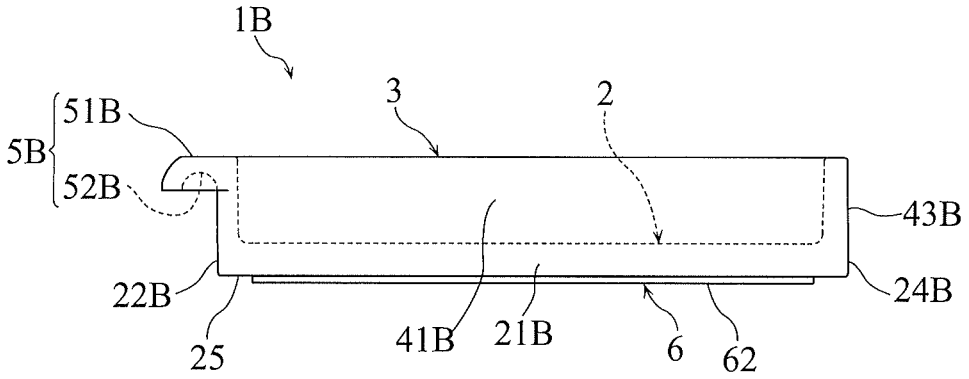
FIG. 8 is a front view of the guiding member shown in FIG. 7.
Figure 10:
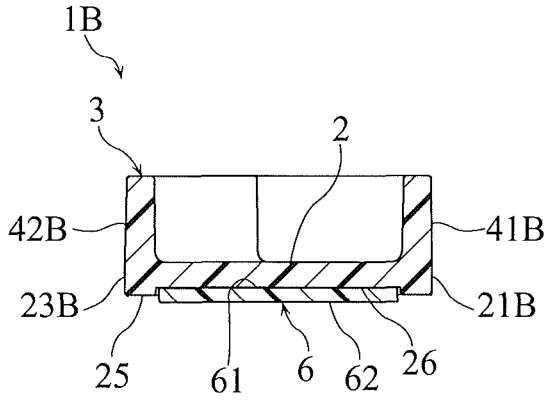
FIG. 10 is a sectional view taken along lines X-X in FIG. 7.

As shown in FIGS. 7, 8 and 10, in the guiding member 1B, the standing wall 3 extends along the entire periphery of the base portion 2 and has a continuous outer surface standing on the edges 21B-24B of the base portion 2. The outer surface of the standing wall 3 includes guide surfaces 41B, 42B and 43B. In this embodiment, all of the guide surfaces 41B, 42B and 43B are flat. The guide surface 41B extends along the edge 21B of the base portion 2 and is made up of the edge 21B and the portion of the outer surface which stands on the edge 21B. The guide surface 42B extends along the edge 23B and is made up of the edge 23B and the portion of the outer surface which stands on the edge 23B. The guide surface 42B is adjacent to the above-described dent of the periphery of the base portion 2. The guide surface 43B extends along the edge 24B and is made up of the edge 24B and the portion of the outer surface which stands on the edge 24B.

As will be understood from FIG. 1, the two guiding members 1A and 1B of this embodiment are configured in such a manner that the edges 21A-24A and the edges 21B-24B are line-symmetric.

Examples of the dimensions of the guiding members 1A and 1B are as follows. The base 2 is about 3 mm in thickness and the standing wall 3 is about 8 mm in height. The height of each of the guide surfaces 41A-43A and 41B-43B is about 11 mm, which corresponds to the total of the thickness of the base portion 2 and the height of the standing wall 3. Each of the edges 21A and 21B of the base 2 is about 55 mm in length, each of the edges 23A and 23B is about 25 mm in length, and each of the edges 24A and 24B is about 15 mm in length.

The guiding member 1A and the guiding member 1B have a connecting portion 5A and a connecting portion 5B, respectively, for connection to each other. In this embodiment, the connecting portion 5A is provided at the top of a portion of the standing wall 3 which stands on the edge 22A. The connecting portion 5B is provided at the top of a portion of the standing wall 3 which stands on the edge 22B.

As shown in FIGS. 2-4 and 6, the connecting portion 5A of the guiding member 1A includes a cut 51A formed at the top of the standing wall 3 and a projection 52A projecting upward. The projection 52A is elongated in the direction in which the edge 22A extends and is generally semicircular in cross section.

As shown in FIGS. 7-9 and 11, the connecting portion 5B includes an eave 51B projecting outward from the top of the sanding wall 3 and a groove 52B formed in the lower surface of the eave 51B. The groove 52B is elongated in the direction in which the edge 22B extends and is generally semicircular in cross section.

Figure 12:
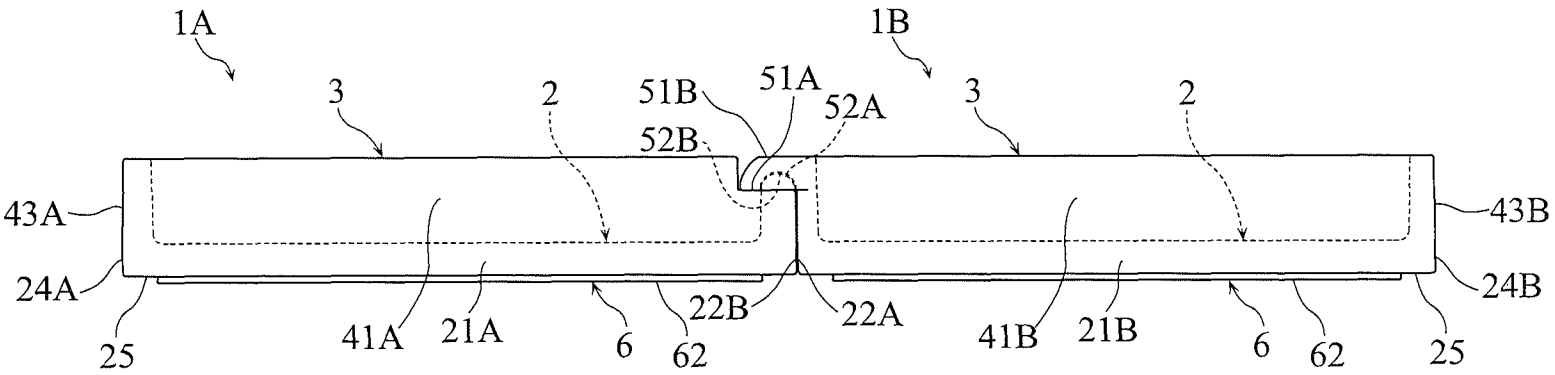
FIG. 12 is a front view showing the two guiding members connected to each other.

As shown in FIG. 12, to connect the guiding members 1A and 1B to each other, the eave 51B of the guiding member 1B is placed on the cut 51A of the guiding member 1A, and the projection 52A of the guiding member 1A is fitted into the groove 52B of the guiding member 1B. As a result, the edge 22A of the base portion 2 and the portion of the outer surface of the side wall 3 which stand on the edge 22A of the guide member 1A come into contact with the edge 22B of the base portion 2 and the portion of the outer surface of the side wall 3 which stands on the edge 22B of the guiding member 1B. In this state, when the guiding tool 1A is held and lifted, the connection of the guiding members 1A and 1B is maintained.

Figure 11:
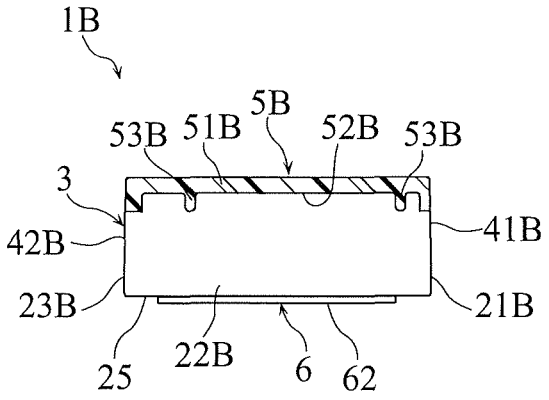
FIG. 11 is a sectional view taken along lines XI-XI in FIG. 7.
Figure 13:
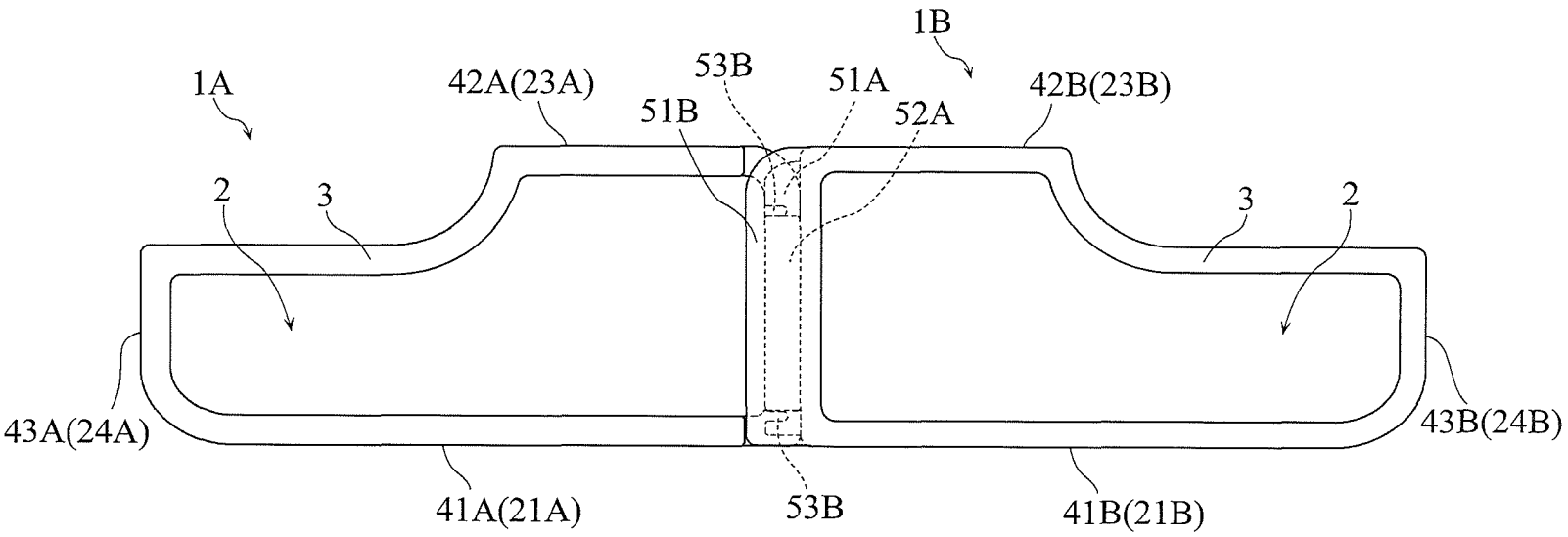
FIG. 13 is a plan view showing the two guiding members connected to each other.

As shown in FIGS. 7, 9 and 11, the groove 52B of the guiding member 1B is provided with a pair of engagement projections 53B at the ends spaced apart from each other in the longitudinal direction of the groove 52B. The distance between the engagement projections 53B is slightly larger than the length of the projection 52A of the guiding member 1A. Thus, when connected to each other, the guiding members 1A and 1B are prevented from moving relative to each other in the direction in which the edges 22A and 22B extend. As shown in FIG. 13, when the guiding members 1A and 1B are connected to each other, the guide surface 41A of the guiding member 1A and the guide surface 41B of the guiding member 1B are flush with each other.

As shown in FIGS. 3-6 and FIGS. 8-11, a sheet member 6 (attaching portion) used for attaching the guiding member 1A or 1B to a needle plate (attachment surface) is provided on the bottom surface 25 of the base portion 2 of each of the guiding members 1A and 1B. The sheet member 6 is self-adhesive and made of a relatively soft synthetic resin such as urethane. The sheet member 6 has a substantially constant thickness. For instance, the sheet member 6 is about 1.0 mm in thickness.

Figure 6:
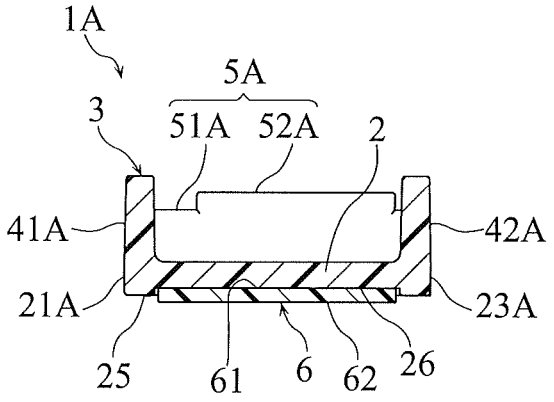
FIG. 6 is a sectional view taken along lines VI-VI in FIG. 2.

As shown in FIGS. 6 and 10, the bottom surface 25 of the base portion 2 is formed with a recess 26 of a substantially constant depth. The depth of the recess 26 is smaller than the thickness of the sheet member 6. For instance, the depth of the recess 26 is about 0.5 mm. As shown in FIGS. 5 and 9, the shapes of the sheet member 6 and the recess 26 are identical to the shape of the periphery of the base portion 2. The sheet member 6 is slightly smaller than the recess 26.

As shown in FIGS. 6 and 10, the sheet member 6 is fitted in the recess 26, with the upper surface 61 bonded to the bottom surface of the recess 26 by e.g. a double-sided adhesive tape (not shown). The lower surface 62 of the sheet member 6 is an adhesive surface and is exposed to the lower side of the base portion 2. In this embodiment, the lower surface 62 of the sheet member 6 projects from the bottom surface 25 of the base portion 2 by about 0.5 mm.

Figure 14:
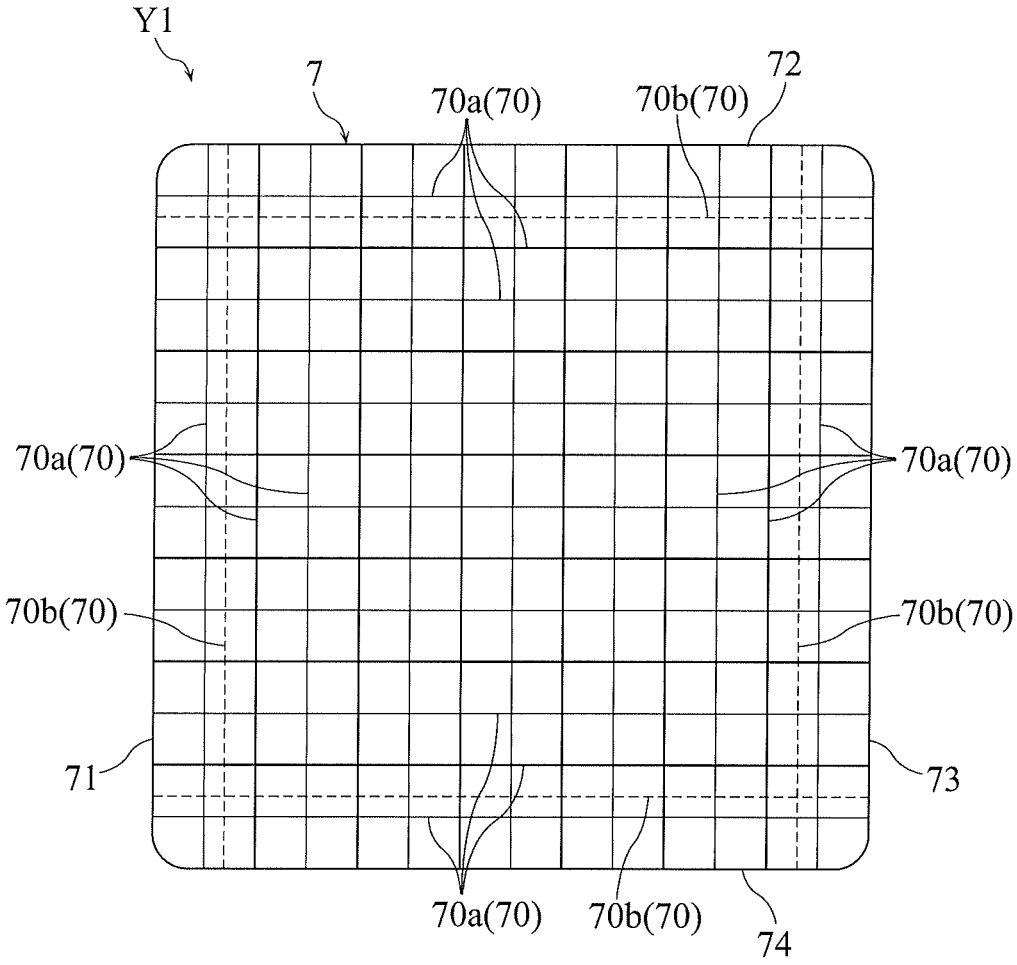
FIG. 14 is a plan view showing a ruled sheet according to an embodiment of the present invention.
Figure 15:
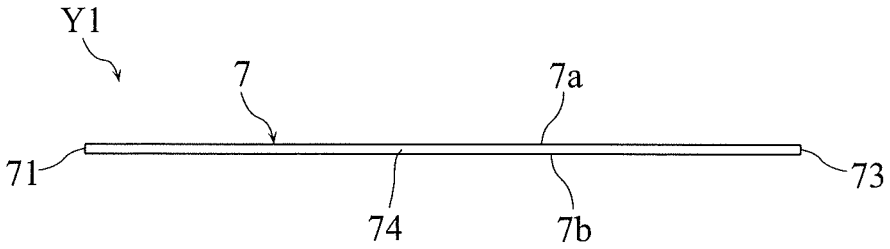
FIG. 15 is a front view of the ruled sheet shown in FIG. 14.

When used, the guiding tool X1 is attached to the needle plate of a sewing machine. Shown in FIGS. 14 and 15 is a ruled sheet Y1, which is an example of a ruled sheet suitably used with the guiding tool X1. The guiding tool X1 and the ruled sheet Y1 shown in FIGS. 14 and 15 constitute a set of a guiding tool for a sewing machine and a ruled sheet of the present invention.

The ruled sheet Y1 of this embodiment includes a sheet body 7 and a plurality of guidelines 70 formed on the sheet body 7. The sheet body 7 is a thin transparent sheet having a substantially constant thickness. In this embodiment, the sheet body 7 is made of a relatively hard synthetic resin such as polyethylene terephthalate. The sheet body 7 has a generally rectangular shape with rounded corners and has edges 71, 72, 73 and 74. The sheet body 7 has an upper surface 7*a* which is a smooth surface and a lower surface 7*b* on which the guidelines 70 are formed by a suitable technique such as silkscreen printing.

As shown in FIG. 14, in this embodiment, the guidelines include a number of solid lines 70*a* and four broken lines 70*b*. The solid lines 70*a* include vertical lines and horizontal lines both of which are provided at regular intervals. In this embodiment, the interval of the vertical lines is 5 mm, so is the interval of the horizontal lines. The leftmost vertical line in FIG. 14 is spaced apart from the edge 71 of the sheet body 7 by 5 mm. The rightmost vertical line in FIG. 14 is spaced apart from the edge 73 of the sheet body 7 by 5 mm. The uppermost horizontal line in FIG. 14 is spaced apart from the edge 72 of the sheet body 7 by 5 mm. The lowermost horizontal line in FIG. 14 is spaced apart from the edge 74 of the sheet body 7 by 5 mm. Each of the four broken lines 70*a* is spaced apart from one of the four edges 71-74 of the sheet body 7 by 7 mm.

The use and advantages of the guiding tool X1 and the ruled sheet Y1 are described below with reference to FIGS. 16-23.

Figure 16:
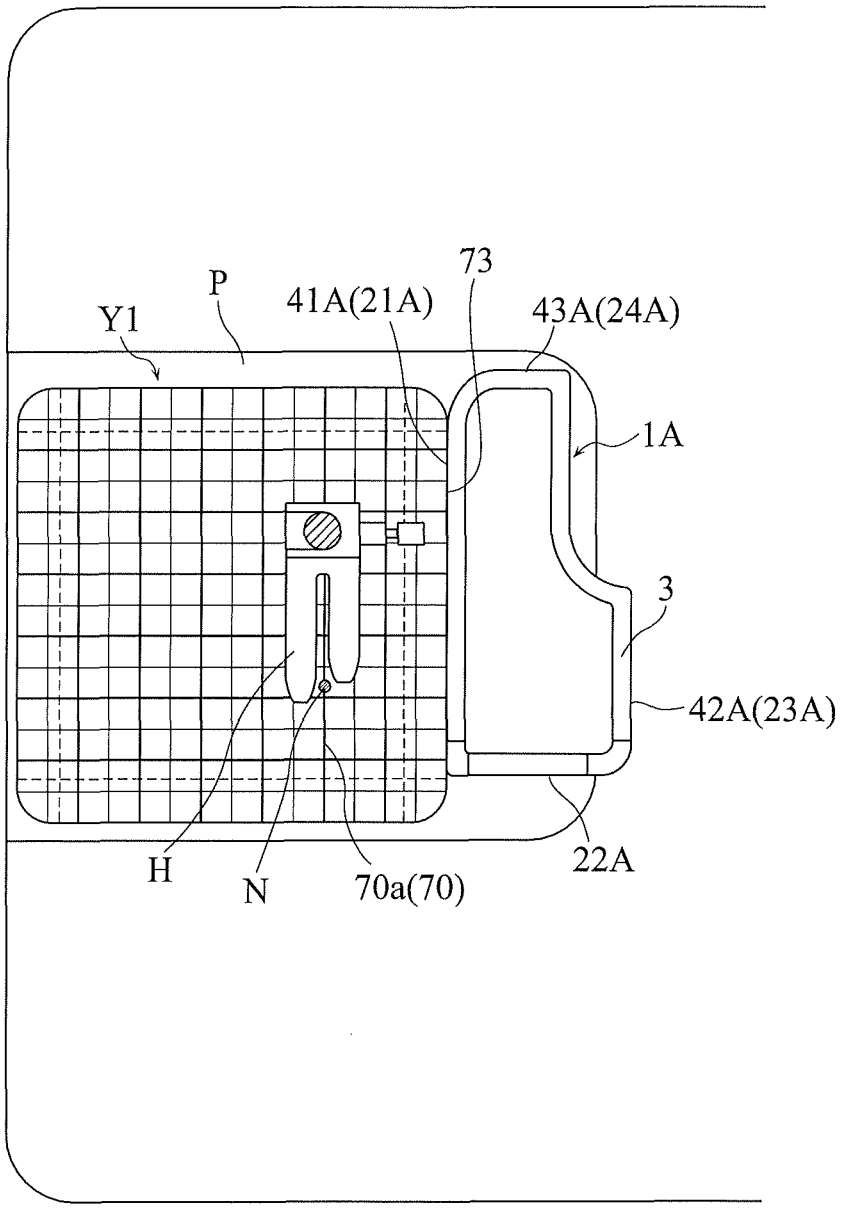
FIG. 16 is a plan view showing an example of use of the guiding tool and the ruled sheet according to the present invention.

To use the guiding tool X1, the guiding member 1A (1B) is attached to a desired position on the needle plate P (attachment surface) of a sewing machine. In attaching the guiding member 1A (1B), the ruled sheet Y1 can be used. Specifically, first, the ruled sheet Y1 is placed on the needle plate P in such a manner that the distance from the edge 71 (72-74) to the needle corresponds to the intended seam allowance. For instance, as shown in FIG. 16, when the seam allowance is 20 mm, the ruled sheet Y1 is placed on the needle plate P in such a manner that the guideline which is 20 mm distant from the edge 73 (the fourth guideline from the edge 73) is positioned directly below the needle N. Then, with the bottom surface 25 of the base portion 2 facing to the needle plate P, the guiding member 1A is attached to the needle plate P so that selected one of the edges 21A, 22A, 23A and 24A adjoins the edge 73 of the ruled sheet Y1. In the example shown in FIG. 16, the guiding member 1A is attached in such a manner that the edge 21A, or the guide surface 41A adjoins the edge 73.

Figure 17:
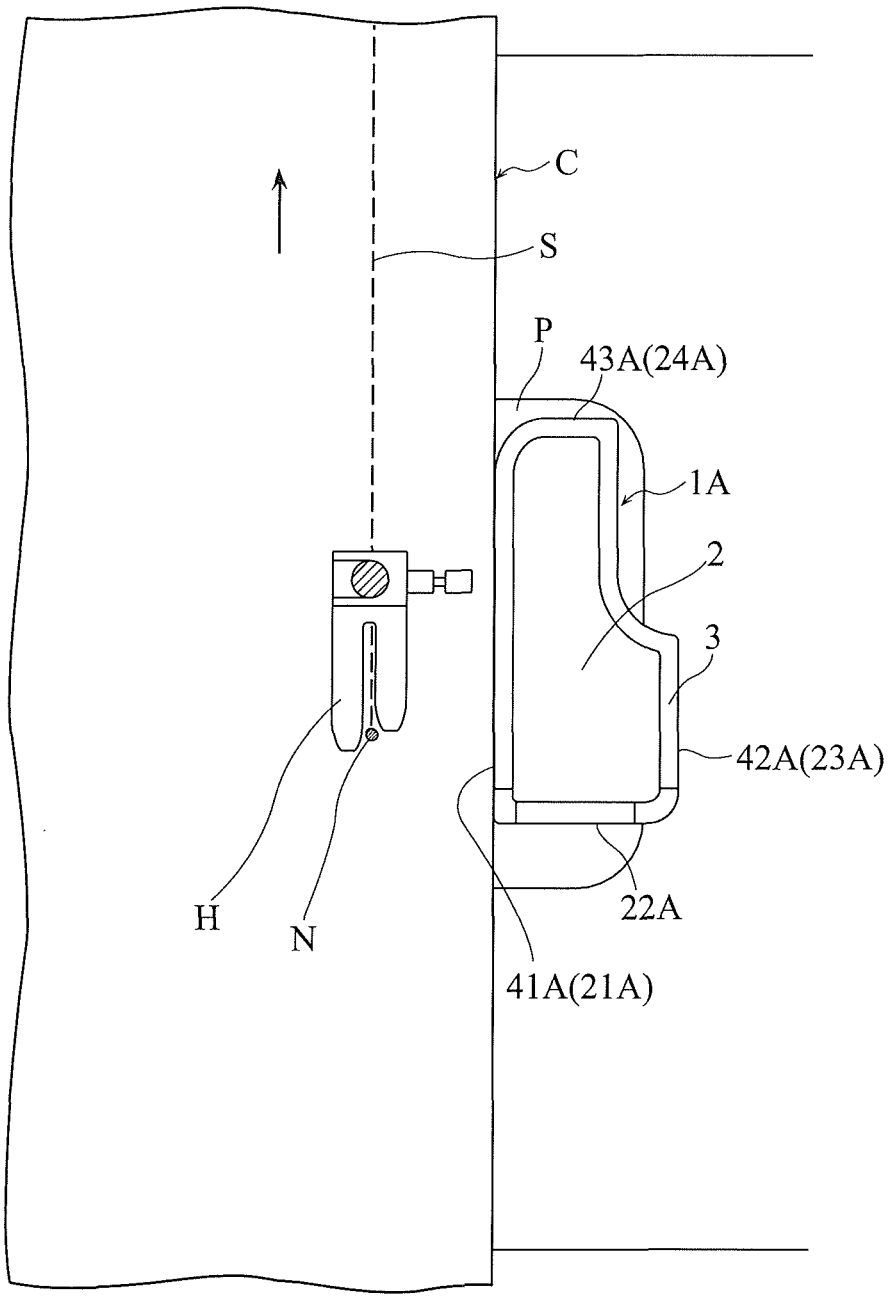
FIG. 17 is a plan view showing an example of use of the guiding tool according to the present invention.

In sewing using the sewing machine, as shown in FIG. 17, the fabric is fed in a predetermined feeding direction (straight upward in this example) with the edge C of the fabric held in contact with the guide surface 41A of the guiding member 1A. Thus, the straight stitching line S is formed while the accurate seam allowance i.e., the area between the stitching line S and the edge C of the fabric, is maintained.

Figure 18:
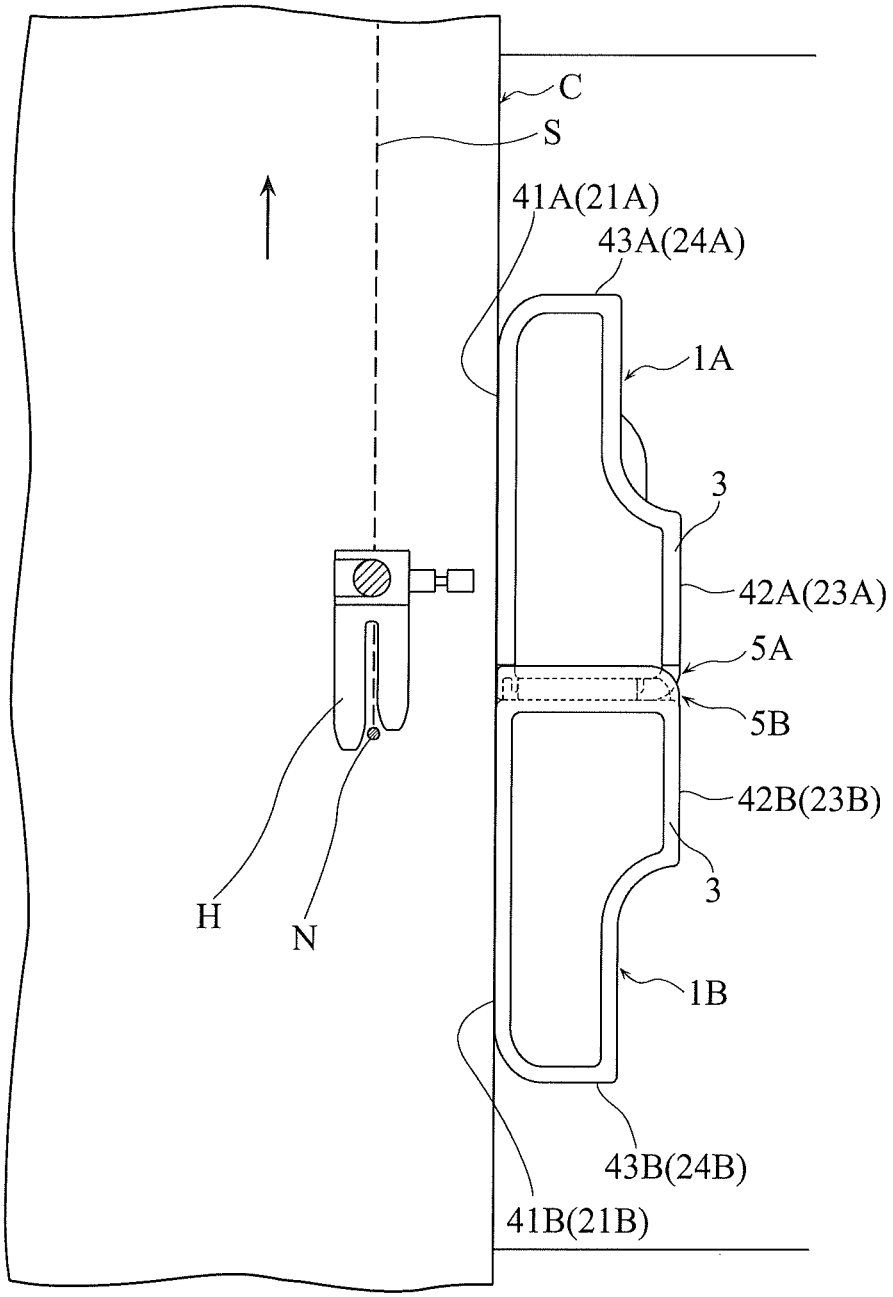
FIG. 18 is a plan view showing an example of use of the guiding tool according to the present invention.

In this embodiment, the guiding members 1A and 1B are provided with connecting portions 5A and 5B for connection to each other. When the guiding members 1A and 1B are connected, the guide surface 41A and the guide surface 41B are flush with each other. Thus, as shown in FIG. 18, when the guiding tool X1 is used with the guiding members 1A and 1B connected to each other, the two guide surfaces 41A and 41B form a continuous flat surface, which can be used as a relatively long straight guide portion. Thus, by feeding the fabric straight with the edge C of the fabric in contact with the guide surfaces 41A and 41B, the straight stitching line S is formed more reliably.

The base portion of the guide member 1A (1B) is provided with the sheet member 6 (attaching portion) on the bottom surface 25. The lower surface 62 of the sheet member 6 is exposed to the bottom surface 25 side of the base portion 2 and self-adhesive. This arrangement allows the guiding member 1A to be attached to the needle plate P due to the adhesive force of the surface 62. Thus, unlike the above-described conventional guiding tool configured to be attached to a needle plate by an attracting force of a magnet, the guiding member 1A (1B) can be attached to a desired position of a needle plate P regardless of the material of the needle plate P (attachment surface).

The sheet member 6 is made of a self-adhesive material. Even when the adhesive force of the lower surface 62 is deteriorated due to e.g. adhesion of dust, the adhesive force is recovered by washing the lower surface 62. This is advantageous to repetitive use of the guiding member 1A (1B).

As noted before, the sheet member 6 is fitted in the recess 26 formed in the bottom surface 25 of the base portion 2. The depth of the recess 26 is made smaller than the thickness of the sheet member 6 so that the lower surface 62 (adhesive surface) of the sheet member 6 projects slightly from the bottom surface 25 of the base portion 2. This assures that the lower surface 62 (adhesive surface) of the sheet member 6 reliably comes into contact with the needle plate P (attachment surface) while the fabric is prevented from entering under the base portion 2. Further, fitting the sheet member 6 into the recess 26 allows the sheet member 6 to be fixed precisely to a predetermined position of the base member 2.

Each of the guiding members 1A and 1B has a standing wall 3 standing on the periphery of the base portion 2 along the entirety of the periphery. With this arrangement, attachment and detachment of the guiding members 1A and 1B to and from the needle plate P (attachment surface) is performed easily by holding the standing wall 3 with a hand.

In the guiding members 1A and 1B, the guide surfaces 41A-43A and 41B-43B are provided by the outer surface of the standing wall 3. Thus, each of the guide surfaces 41A-43A and 41B-43B has a relatively large height, or the vertical dimension. Thus, relatively thick fabric can also be guided properly. Further, since the standing wall 3 has a closed shape, small things such as pins can be stored in the space inside the wall, which is convenient.

Figure 19:
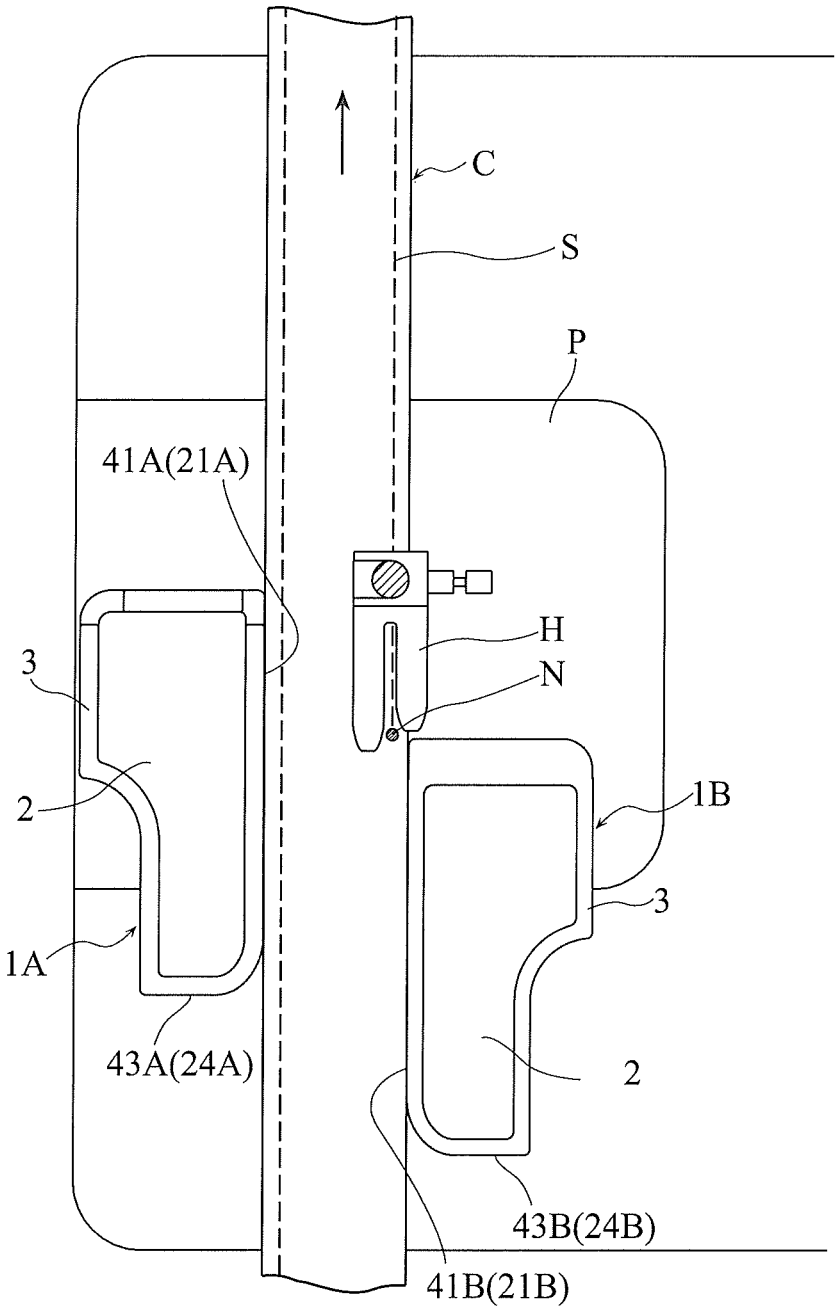
FIG. 19 is a plan view showing an example of use of the guiding tool according to the present invention.

As shown in FIG. 19, when the fabric has a relatively small width, the guiding member 1A and the guiding member 1B may be arranged in parallel to each other and the fabric is sandwiched between the guide surface 41A of the guiding member 1A and the guide surface 41B of the guiding member 1B. By using the guiding tool in this way, even the fabric having a small width can be guided properly.

As noted above, the guiding member 1A (1B) have guide surfaces 41A-43A (41B-43B) of different lengths (dimensions in the horizontal direction). Thus, various types of sewing can be performed properly by selecting a suitable guide surface from the guide surfaces 41A-43A (41B-43B), in accordance with e.g. the shape or size of the fabric or the size of the needle plate (attachment surface).

For instance, to form a straight stitching line by feeding the fabric straight, the longest guide surface 41A (41B) may be used, as shown in FIG. 17. Though FIG. 17 shows the use of the guiding member 1A, the guiding member 1B may be used instead. When the attachment surface is relatively large, the two guiding members 1A and 1B may be used as connected to each other, as shown in FIG. 18. In this case, the fabric can be guided along a further longer guide surface made up of the two guide surfaces 41A and 41B.

Figure 20:
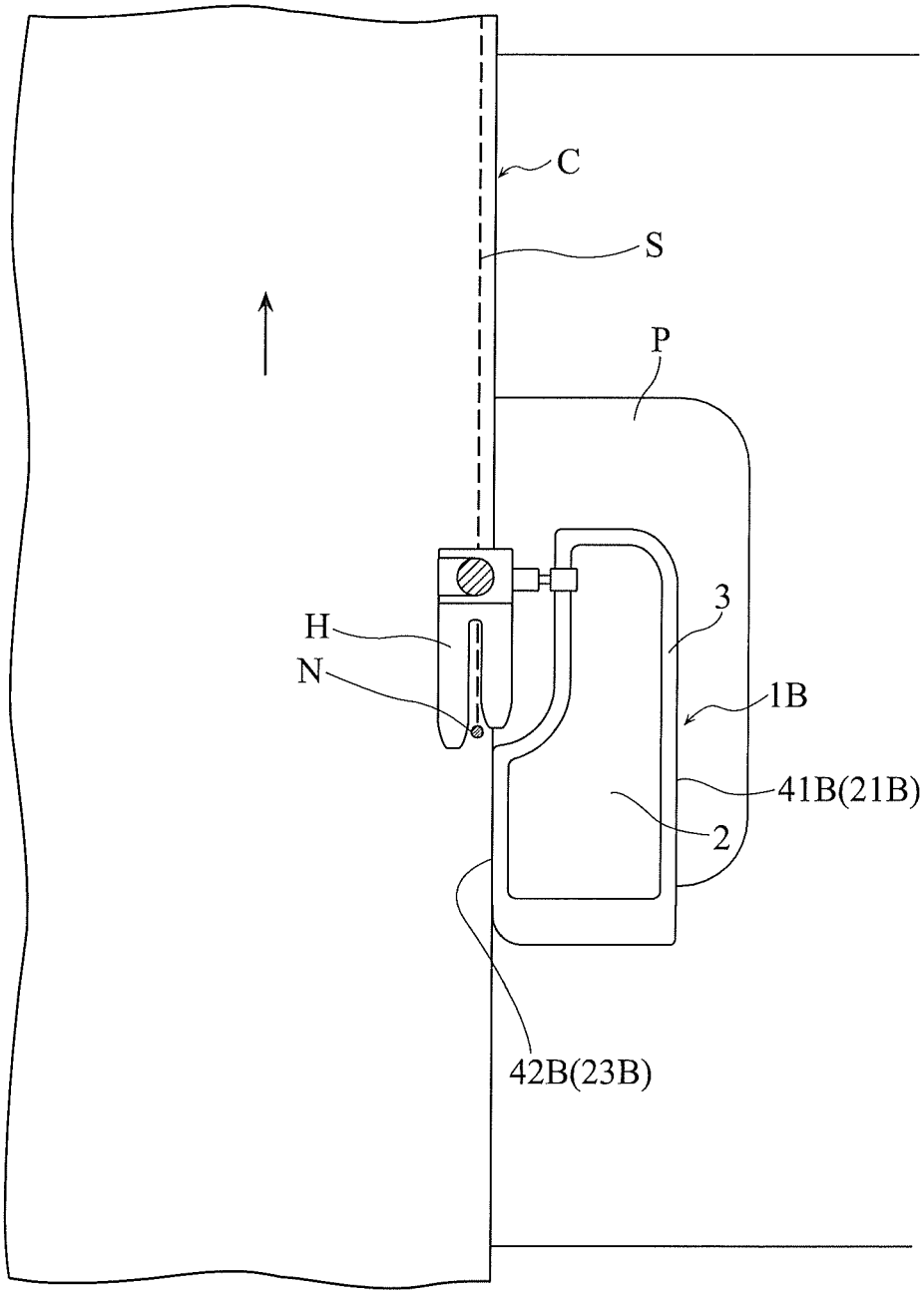
FIG. 20 is a plan view showing an example of use of the guiding tool according to the present invention.

The guide surface 42A (42B) is shorter than the guide surface 41A (41B) and adjacent to the above-described dent of the periphery of the base portion 2. As shown in FIG. 20, by using this relatively short guide surface 42B, the guiding member 1B can be placed relatively close to the needle N without coming into contact with the presser foot H. Though FIG. 20 shows the use of the guiding member 1B, the guiding member 1A may be used instead.

Figure 21:
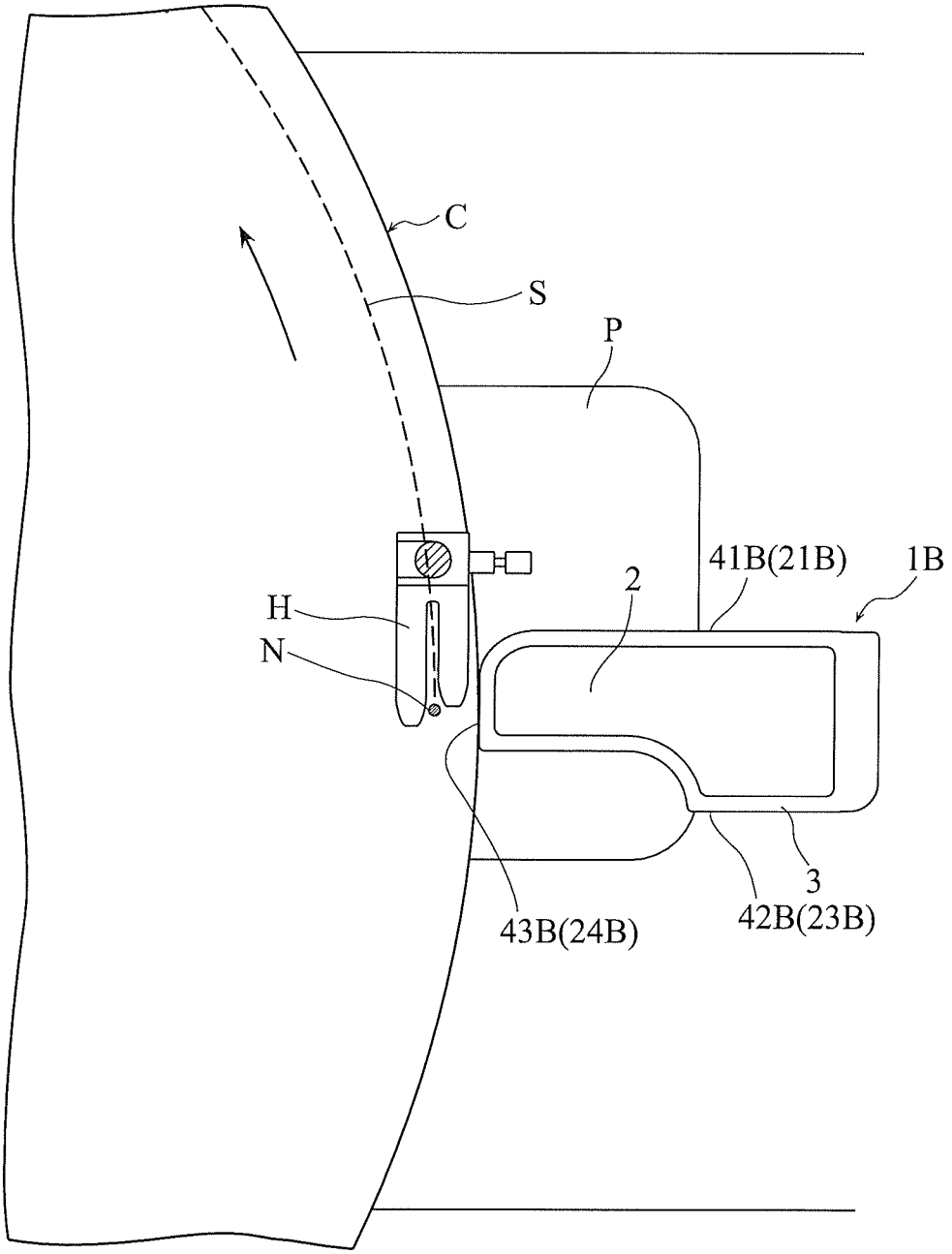
FIG. 21 is a plan view showing an example of use of the guiding tool according to the present invention.

The guide surface 43A (43B) is the shortest among the three guide surfaces. To form a curved stitching line S, the shortest guide surface 43B of the guiding member 1B may be used, as shown in FIG. 21. By using the shortest guide surface, a curved stitching line is formed properly. Though FIG. 20 shows the use of the guiding member 1B, the guiding member 1A may be used instead.

Figure 22:
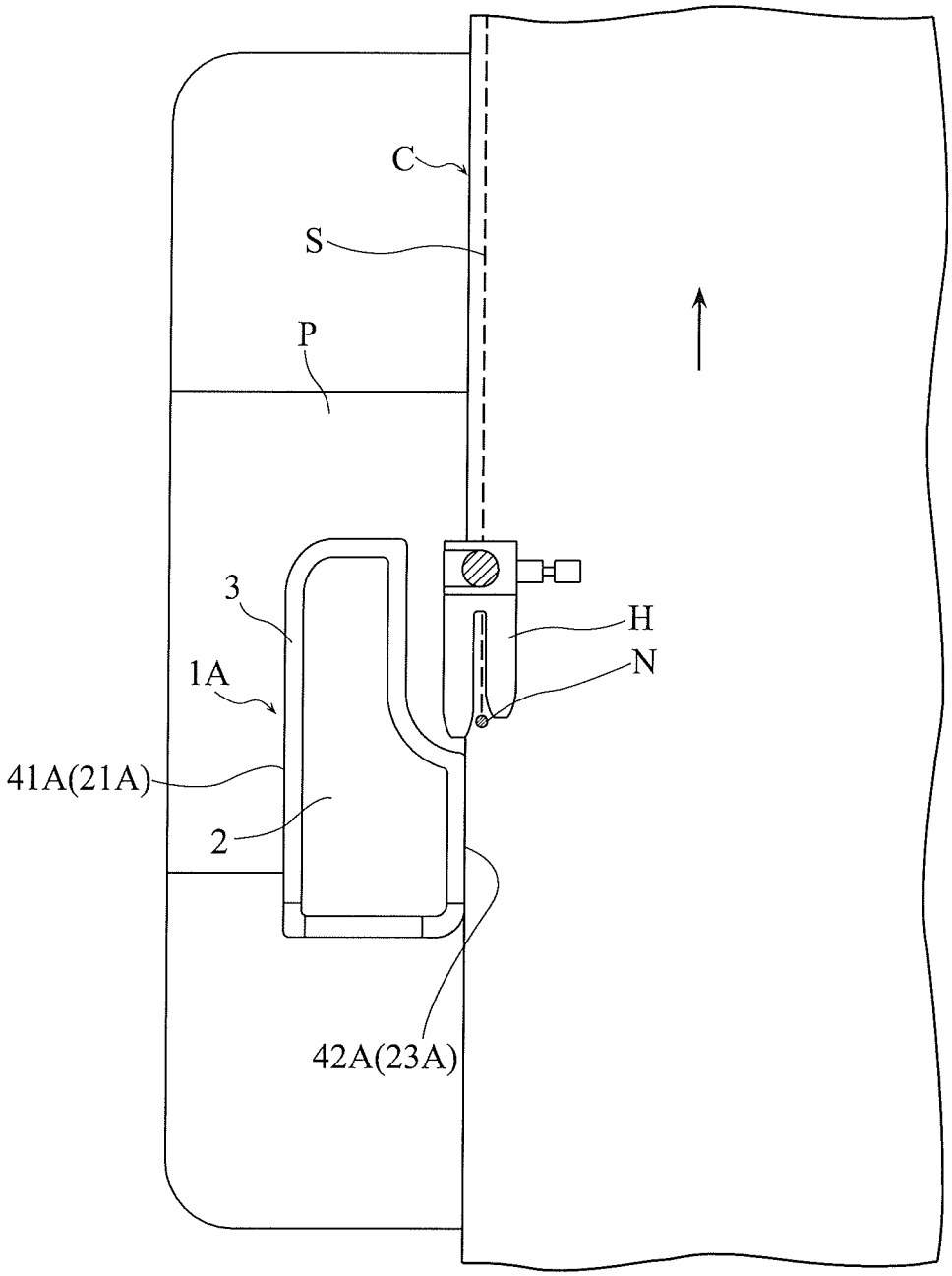
FIG. 22 is a plan view showing an example of use of the guiding tool according to the present invention.

The guide surfaces 41A, 42A, 43A of the first guiding member 1A and the guide surfaces 41B, 42B, 43B of the second guiding member 1B are line-symmetric, respectively. Thus, for instance, after one edge of fabric is sewn by using the guide surface 42B of the guiding member 1B as shown in FIG. 20, the opposite edge of the fabric can be sewn by using the guide surface 42A, which is line-symmetric with the guide surface 42B, of the guiding member 1A, as shown in FIG. 22. In this way, by appropriately using the line-symmetric guide surfaces, various types of sewing can be performed easily and properly.

Figure 23:
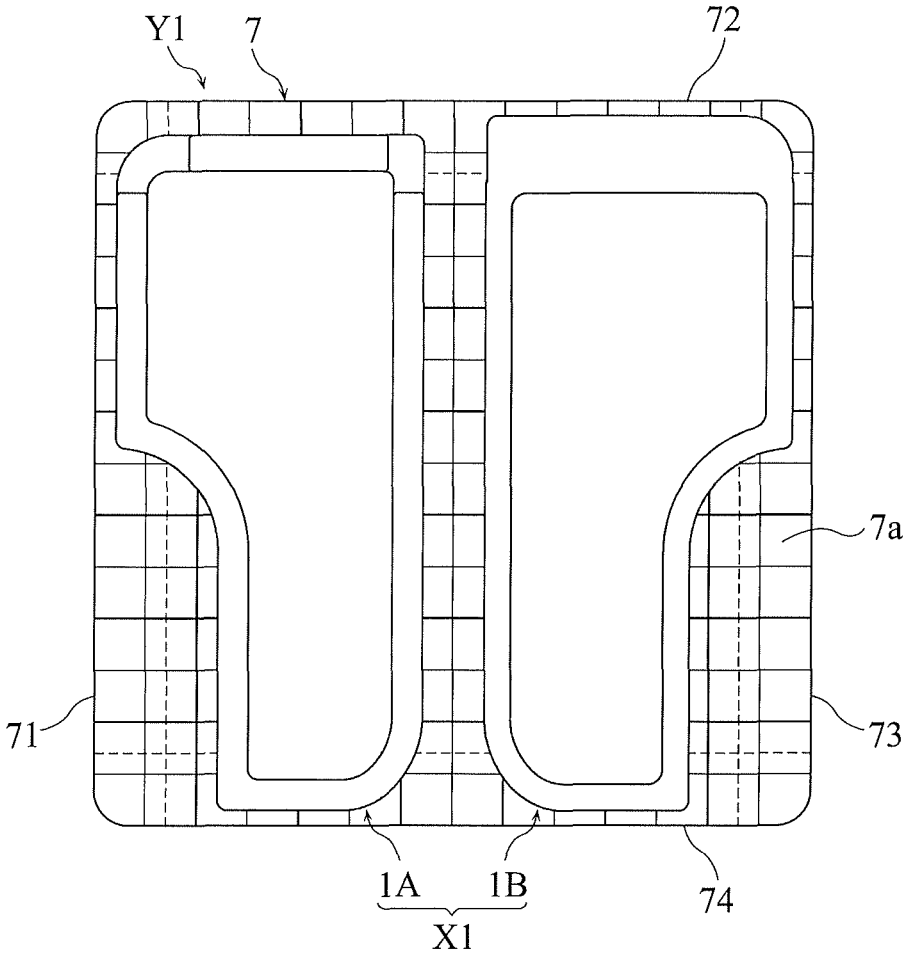
FIG. 23 is a plan view showing an example of how the guiding tool and the ruled sheet according to the present invention are stored.

The upper surface 7*a* of the ruled sheet Y1 (sheet body 7) is a smooth surface. Thus, as shown in FIG. 23, when the guiding members 1A and 1B (guiding tool X1) are not used, the guiding members 1A and 1B may be stored as attached to the upper surface 7*a* of the sheet member 7. Thus, the guiding tool X1 and the ruled sheet Y1 can be stored collectively, which is convenient.

Though a preferred embodiment of the present invention is described above, the present invention is not limited to this and may be varied in various ways without departing from the spirit of the present invention. For instance, the specific shape or material of the guiding tool or the ruled sheet of the present invention is not limited to that of the foregoing embodiment.

Though each of the guiding members 1A and 1B includes a base portion 2 in the form of a flat plate and a standing wall 3 standing on the periphery of the base portion 2 in the foregoing embodiment, the present invention is not limited to this arrangement. For instance, the base portion 2 may be made to have a relatively large thickness so that the side surface of the base portion 2 can serve as guide surfaces. In this case, the standing wall 3 may be dispensed with.

In the foregoing embodiment, the attaching portion provided on the bottom surface of the base portion 2 is provided with a self-adhesive sheet member. However, the attaching portion may be configured otherwise as long as it can be attached to an attachment surface of an object due to adhesion or suction. For instance, the attaching portion may utilize an adhesive tape or a suction cup.

The invention claimed is:

1. A guiding tool for a sewing machine, comprising:

a first guiding member; and a second guiding member;

wherein each of the first guiding member and the second guiding member includes a base portion having a predetermined periphery, a first guide surface connected to the base portion, and a connecting portion for connection of the first guiding member and the second guiding member to each other, the base portion includes a bottom surface provided with an attaching portion to be attached to an object by adhesion or suction, the first guide surface of the first guiding member and the first guide surface of the second guiding member are configured to be flush with each other when the first guiding member and the second guiding member are connected to each other, each of the first guiding member and the second guiding member includes a second guide surface and a third guide surface both connected to the base portion of said each of the first guiding member and the second guiding member, in each of the first guiding member and the second guiding member, the first, the second and the third guide surfaces extend along a first edge, a second edge and a third edge of the periphery of the base portion, respectively, the third edge being shorter than the second edge, the second edge being shorter than the first edge, the base portion of each of the first and the second guiding members is in a form of a flat plate, each of the first and the second guiding members includes an upright wall standing on the periphery of the base portion and extending along the entirety of the periphery, and the upright wall includes an outer surface providing the first, the second and the third guide surfaces.

2. The guiding tool according to claim 1, wherein the first, the second and the third edges of the first guiding member are line-symmetric to the first, the second and the third edges of the second guiding member, respectively.

3. The guiding tool according to claim 1, wherein in each of the first guiding member and the second guiding member, the attaching portion includes an adhesive surface projecting outward from the bottom surface of the base portion.

4. The guiding tool according to claim 3, wherein the attaching portion comprises a self-adhesive sheet including a first surface and a second surface facing in mutually opposite directions, and the first surface is fixed to the bottom surface of the base portion, and the second surface provides the adhesive surface.

5. The guiding tool according to claim 4, wherein the bottom surface of the base portion is provided with a recess having a depth smaller than a thickness of the attaching portion, and the attaching portion is partially fitted in the recess.

6. A set comprising:

a guiding tool according to claim 1; and a ruled sheet;

wherein the ruled sheet includes at least one straight edge and a plurality of guidelines spaced apart from the straight edge.

7. The set according to claim 6, wherein the ruled sheet includes a first surface and a second surface facing in mutually opposite directions, the first surface being a smooth surface, the second surface being provided with the plurality of guidelines.

* * * * *